US008733608B2

(12) United States Patent
Segura et al.

(10) Patent No.: US 8,733,608 B2
(45) Date of Patent: May 27, 2014

(54) SIDE-BY-SIDE MULTI-STRIP MAGAZINE FOR FASTENER DRIVING TOOL

(75) Inventors: Ricardo Segura, Lake in the Hills, IL (US); Ryan Francis, Palatine, IL (US)

(73) Assignee: Illinois Tool Works Inc., Glenview, IL (US)

( * ) Notice: Subject to any disclaimer, the term of this patent is extended or adjusted under 35 U.S.C. 154(b) by 335 days.

(21) Appl. No.: 13/102,188

(22) Filed: May 6, 2011

(65) Prior Publication Data

US 2012/0280016 A1 Nov. 8, 2012

(51) Int. Cl.
*B25C 5/16* (2006.01)

(52) U.S. Cl.
USPC ..... 227/120; 227/109

(58) Field of Classification Search
USPC ..... 227/109, 120, 135, 136, 132
See application file for complete search history.

(56) References Cited

U.S. PATENT DOCUMENTS

| | | | | |
|---|---|---|---|---|
| 3,266,697 | A * | 8/1966 | Fiedler | 227/120 |
| 3,437,249 | A * | 4/1969 | Baum | 227/120 |
| 5,192,012 | A | 3/1993 | Schafer et al. | |
| 5,626,274 | A | 5/1997 | Shkolnikov et al. | |
| 6,655,572 | B2 * | 12/2003 | Amada | 227/109 |
| 6,729,523 | B1 * | 5/2004 | Wang et al. | 227/120 |
| 7,314,155 | B2 * | 1/2008 | Moeller et al. | 227/127 |
| 8,181,836 | B2 * | 5/2012 | Shkolnikov et al. | 227/120 |
| 2004/0056065 | A1 * | 3/2004 | Wasko | 227/109 |

* cited by examiner

*Primary Examiner* — Andrew M Tecco
(74) *Attorney, Agent, or Firm* — Greer, Burns & Crain, Ltd.; Maurice E. Finnegan, III; Mark W. Croll

(57) ABSTRACT

A magazine assembly for a fastener driving tool having a nosepiece defining a fastener passageway includes an inner mobile member at least partially defining at least first and second chambers for receiving fasteners, and an outer stationary member at least partially surrounding the inner mobile member and engageable relative to the nosepiece. The inner mobile member is movable relative to the outer stationary member in a direction transverse to fastener travel in the magazine assembly.

16 Claims, 5 Drawing Sheets

SIDE-BY-SIDE MULTI-STRIP MAGAZINE FOR FASTENER DRIVING TOOL

BACKGROUND

The present invention relates generally to fastener-driving tools used to drive fasteners into workpieces, such tools typically being powered by combustion, pneumatics, electricity, powder activated or by other sources, and more particularly to fastener magazines for such tools.

Fastener-driving tools typically include a housing enclosing a power source which drives the fasteners, a handle or grip and a magazine to hold and advance fasteners for driving into the workpiece by the power source. Fasteners for such tools are typically provided in linear strips in which adjacent fasteners are held together with adhesive, welded wire, plastic or paper webbing, collation strips or the like. In the magazine, a follower biased by a return spring urges the fasteners from a rear end of the magazine, typically where the fasteners are loaded into the magazine, to the front end of the magazine which is adjacent a nosepiece. In the nosepiece, the fasteners are impacted by a reciprocating drive blade and driven into the workpiece.

Conventional tools typically are provided with magazines capable of holding either single or double fastener strips. Pneumatic framing tools are manufactured almost exclusively with two strip capacity magazines, since these tools are used in production applications where large volumes of fasteners are driven. The larger capacity magazine reduces the reloading interruption period by 50%. In some applications, coil magazines are provided.

In contrast, cordless portable fastener driving tools, especially of the framing or trim type, are typically provided only with single fastener strip capacity magazines. The lower capacity of the magazine is designed to improve portability, tool balance and user ergonomics. In addition, cordless tools are intended to be usable in tight or confined areas such as roof trusses and remodeling projects, where longer, higher capacity magazines are often a hindrance.

Despite the above-identified conventions, there is a need for users of portable tools to have the ability to load multiple fastener strips at a time for some applications. One proposed solution is an extended modular magazine as disclosed in U.S. Pat. No. 7,314,155, issued on Jan. 1, 2008, which is hereby incorporated by reference. While such a solution addresses some of the need for a higher capacity, users may have need of the increased capacity without the added length of the extended magazine, which may cause the tool to be awkward for some applications.

Additionally, there is a need for users of pneumatic tools to garner the ergonomic and portability benefits of a single fastener strip capacity magazine without sacrificing the reduced reloading period provided by larger capacity magazines.

Thus, there is a need for a fastener-driving tool having the capability of employing multiple fastener strips in a way that addresses the problems discussed above.

SUMMARY

The above-listed needs are met or exceeded by the present side-by-side multi-strip magazine for a fastener-driving tool. Basically, the present magazine accommodates a pair of fastener strips in side-by-side orientation. As the first strip is used the magazine is constructed so that the second strip is laterally slid into place, then is urged toward the tool nosepiece. The user can select which strip to use by actuating an external lever.

More specifically, a magazine assembly is provided for a fastener driving tool having a nosepiece defining a fastener passageway. The magazine includes an inner mobile member at least partially defining at least first and second chambers for receiving fasteners, and an outer stationary member at least partially surrounding the inner mobile member and engageable relative to the nosepiece. The inner mobile member is movable relative to the outer stationary member in a direction transverse to fastener travel in the magazine assembly.

Another embodiment of a magazine assembly for a fastener driving tool having a nosepiece defining a fastener passageway has a movable member at least partially defining at least first and second chambers for receiving fasteners, said first and second chambers disposed in parallel relative to one another. The magazine also includes a stationary track member having a fastener track and a stop. The fastener track is aligned with the fastener passageway of the nosepiece of the tool. A translational member of the magazine assembly facilitates translational movement of said movable member between a first position and a second position in a direction transverse to the direction of travel of fasteners in the magazine.

DETAILED DESCRIPTION

Figure 1:
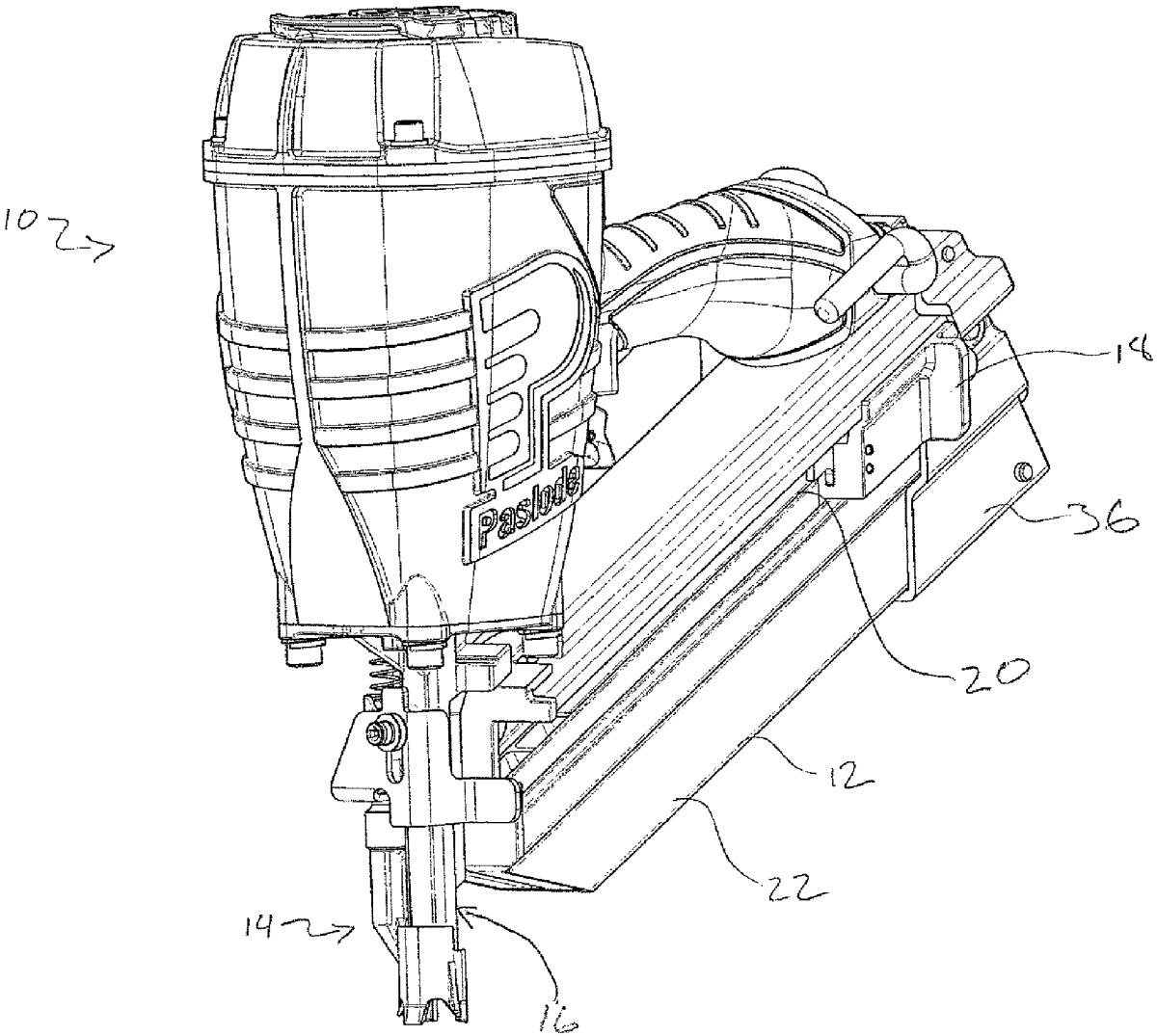
FIG. 1 is a front perspective view of a fastener-driving tool equipped with the present side-by-side multi-strip magazine.

Referring now to FIG. 1, a fastener-driving tool suitable for use with the present side-by-side multi-strip magazine is generally designated 10. The tool 10 is contemplated as being any fastener-driving tool, whether combustion powered, pneumatic, electric, powder activated or operated by other power sources, as long as a fastener magazine is employed. In the present application, the entire tool 10 is not depicted and described, since such tools are well known in the art. The tool 10 includes a side-by-side multi-strip magazine 12 removably mounted on the tool. A front end 14 of the tool 10 has a nosepiece or shear block 16 which defines a fastener passageway (not shown) through which the nosepiece receives fasteners from the magazine 12 and, through the action of a driver blade (not shown), drives fasteners into a workpiece.

Figure 3:
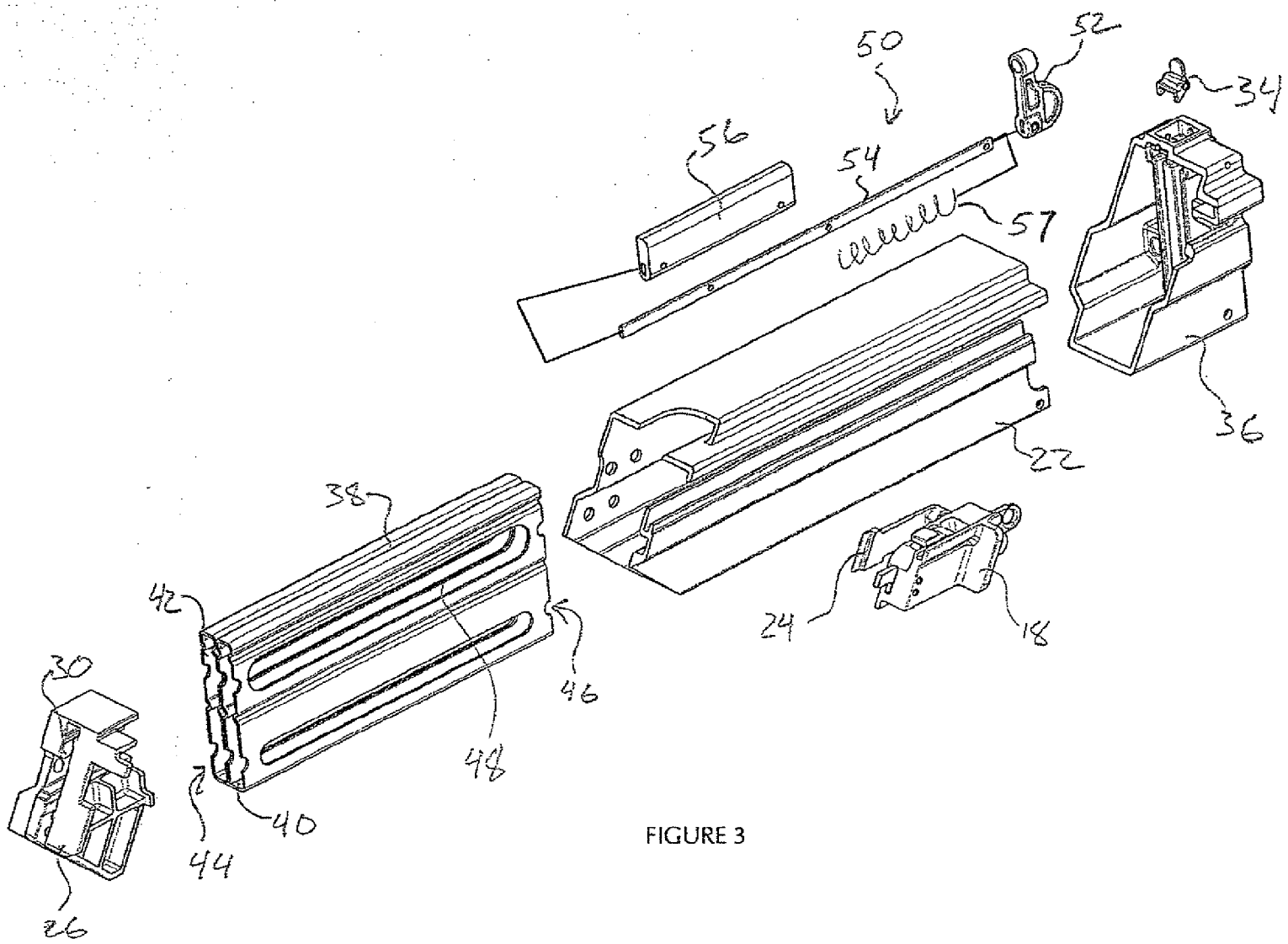
FIG. 3 is an exploded perspective view of the magazine assembly of FIG. 2.

The magazine 12 includes a follower body 18 slidably engaged in a slot or channel 20 formed in an outer stationary member 22 and being connected to a follower 24 (shown in FIG. 3). The follower body 18 and the follower 24 are connected to a follower return spring (not shown), which urges the follower, and fasteners located in the magazine 12, toward the nosepiece 16 as is known in the art. As shown in FIG. 1, the magazine 12 has a length that is approximately equal to the length of a standard one-strip magazine, however longer magazines having multiple fastener strips are contemplated.

Figure 2:
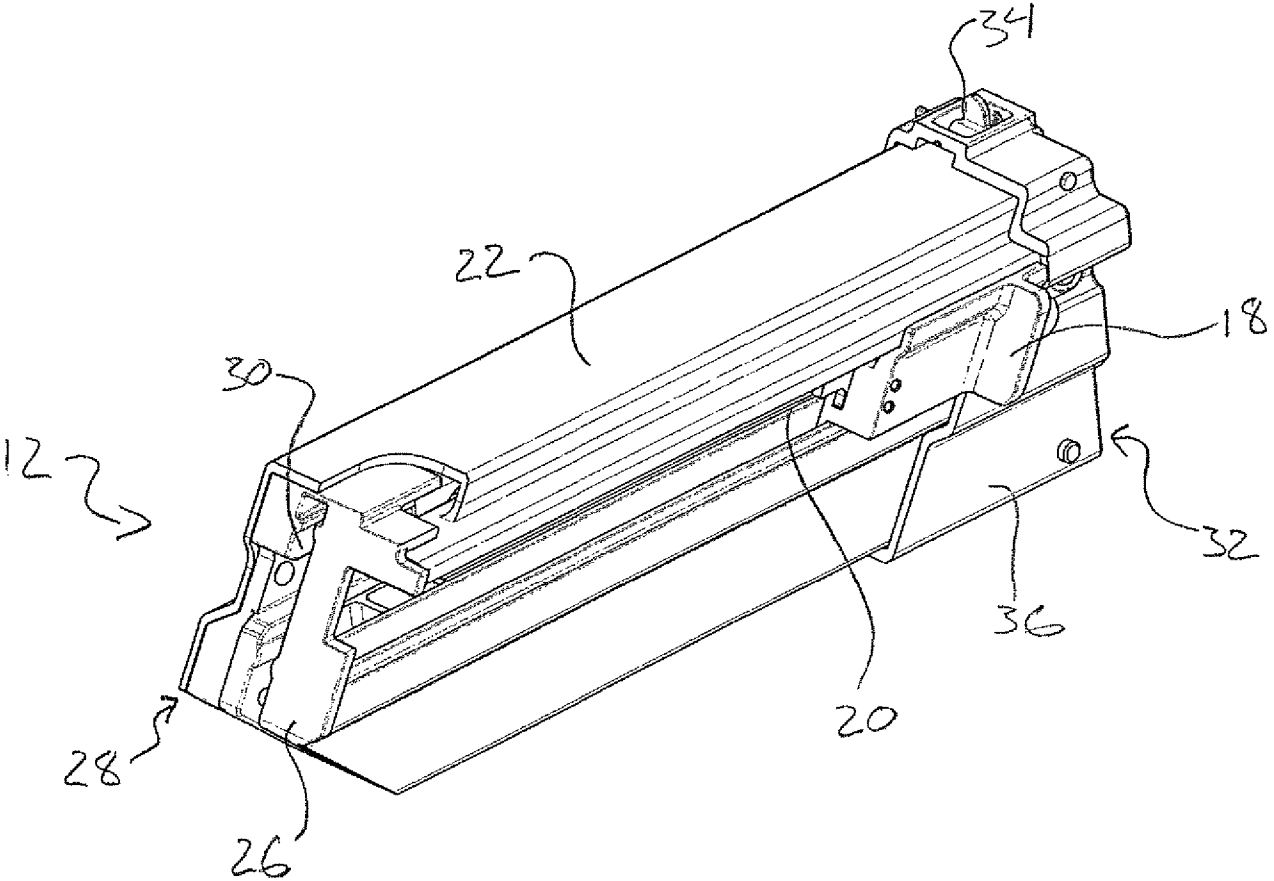
FIG. 2 is a front perspective view of the multi-strip magazine of FIG. 1, detached from the tool.

Referring now to FIG. 2, the magazine further includes an inner stationary member 26 at a front end 28 of the magazine 12. The inner stationary member 26 is fixed to the outer stationary member 22, and defines a fastener track 30 that guides fasteners from the magazine to the fastener passageway of the tool nosepiece 16. At a rear end 32 of the magazine 12, a retaining pawl 34 helps prevent fasteners from escaping rearwardly. The rear end 32 of the magazine 12 is covered by an endcap 36, which helps to enclose and protect the various components of the magazine 12. The endcap 36 is attached to the outer stationary member 22 by one of various known methods, including fasteners, chemical adhesives, friction fit and the like.

Referring now to FIG. 3, constituent parts of the magazine 12 are shown in an exploded view. An inner mobile member 38 retains fasteners in first and second elongate chambers 40, 42. The elongate chambers 40 and 42 are arranged side-by-side, are open at each end, and are generally parallel with respect to one another. Each chamber is sized to receive a fastener strip. While it is contemplated that the inner mobile member 38 may include more chambers, only two are illustrated for simplicity. A front portion 44 of the inner mobile member 38, when assembled in the magazine 12, is adjacent to the internal stationary member 26, so that fasteners may pass from an aligned one of the first and second chambers 40, 42 into the passageway 30 of the inner stationary member. A rear portion 46 of the inner mobile member 38 is disposed adjacent to the rear end 32 of the magazine 12 to facilitate loading fasteners into the first and second chambers 40, 42. The inner mobile member 38 also includes a slot or channel 48 to allow the follower 24 to engage fasteners in the first and second chambers, and urge the fasteners towards the front portion 44.

The magazine 12 also includes a translational lever assembly 50. The lever assembly 50 includes a lever or handle 52 rigidly attached to an actuator, such as a cam shaft 54 provided with at least one cam lock 56 shown in FIG. 3. While the cam shaft 54 and the cam lock 56 are shown, it will be appreciated by those of skill in the art that alternative actuators could be used without departing from the scope of the present invention. The cam shaft 54 is attached to the lever 52 by a known manner, such as by a fastener, using a friction fit, adhesive, being formed integrally with the lever, and the like, so long as the connection between the lever and the shaft is rigid. Similarly, the cam lock 56 is preferably rigidly attached to the cam shaft 54 by any known fastening technology. A coil spring 57 at least partially surrounds a portion of the cam shaft 54, and is trapped between the cam lock 56 and the end cap 36. Thus, the spring 57 biases the lever assembly 50 toward the front end 28 of the magazine 12. While FIG. 3 shows a single cam lock 56, it will be appreciated by those of skill in the art that additional cam locks may be attached to the cam shaft 54 without departing from the spirit of the invention.

The lever assembly 50, when installed in the magazine 12, is rotatable without tools to facilitate translational movement of the inner mobile member 38 within the outer stationary member 22. To rotate the lever 52, a user first pulls the lever outward, against the biasing force of the spring 57. After the biasing force of the spring 57 has been overcome, the lever 52 may be rotated. Rotation of the lever 52 causes the cam shaft 54 and cam lock 56 to rotate, urging movement of the internal mobile member 38.

Figure 5:
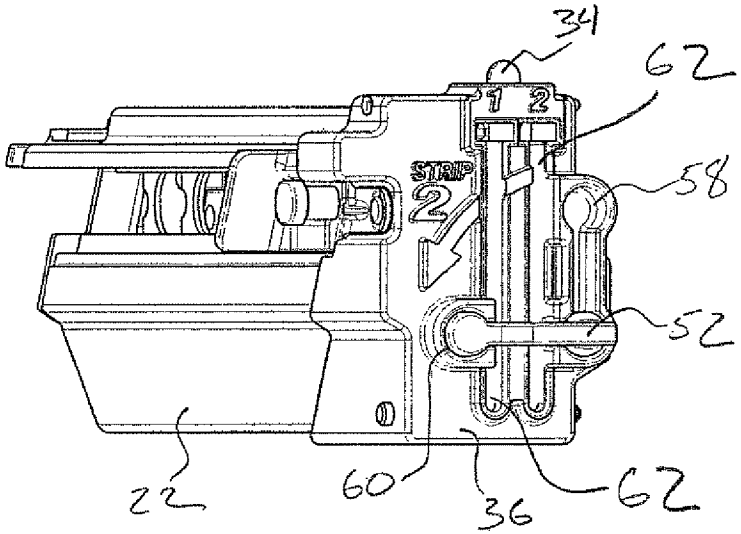
FIG. 5 is a rear perspective view of the magazine assembly of FIG. 2 in the second position.
Figure 4:
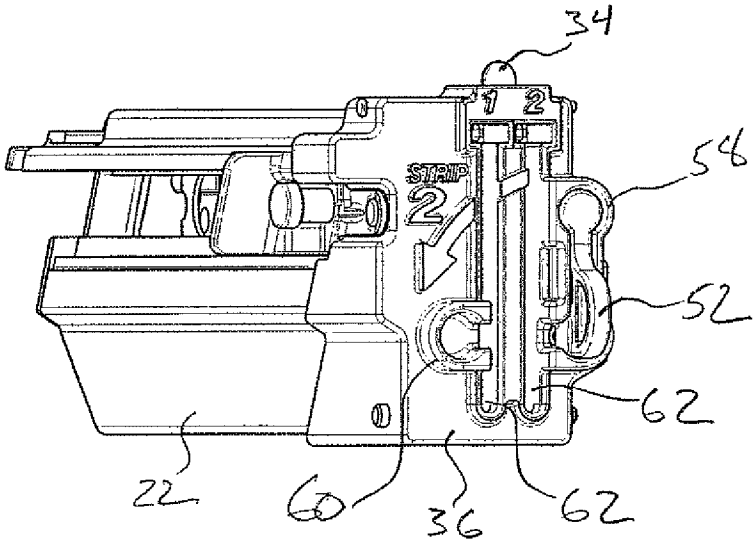
FIG. 4 is a rear perspective view of the magazine assembly of FIG. 2 in the first position.

Referring now to FIGS. 4 and 5, the endcap 36 includes a first position retainer 58 for retaining the lever 52 in a first position, and a second position retainer 60 for retaining the lever 52 in a second position. FIG. 4 shows the lever 52 retained in the first position, while FIG. 5 shows the lever retained in the second position, such retention preferably accomplished by the spring 57 biasing the lever towards the front end 28 of the magazine 12. Additional retention methods, such as a friction fit, are also contemplated.

When the lever 52 is in the first position, two openings 62 allow a user to insert a fastener strip into each of the first and second chambers 40, 42. When the lever 52 is in the second position, the first and second chambers are no longer aligned with the openings 62. Accordingly, the lever 52 is positioned across the openings 62 to visually remind users that the slots are not aligned with the chambers, and to help physically prevent insertion of fasteners into the openings. The openings 62 are preferably sized and shaped to accommodate the fastener type used by the tool.

Figure 6:
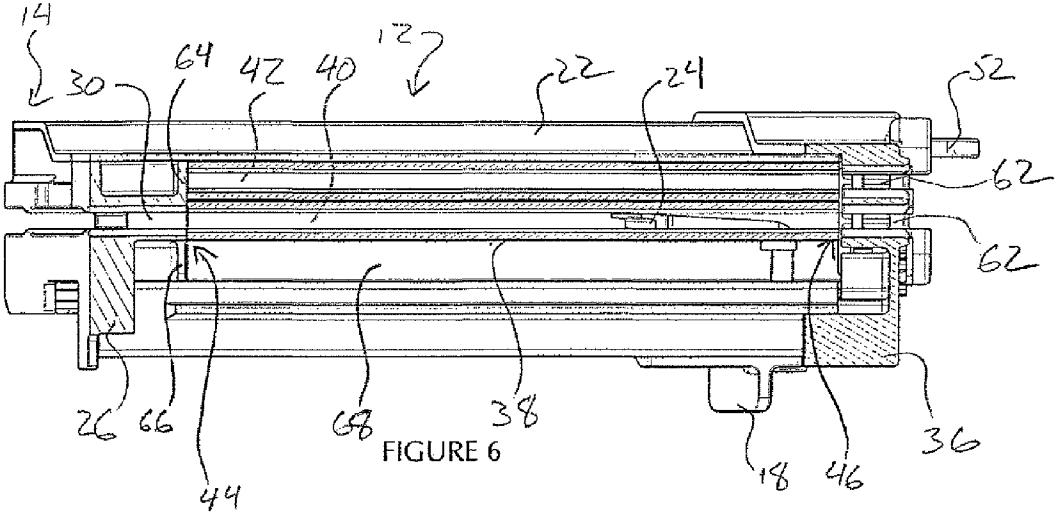
FIG. 6 is a cross-sectional plan view of the magazine assembly of FIG. 2, in the first position.

Referring now to FIG. 6, a sectional plan view of the magazine 12 when the lever 52 is in the first position is shown. The inner mobile member 38 is biased toward a right side of the magazine 12 using a biasing member such as one or more springs (shown in FIG. 8), so that the inner mobile member is in a first position. When in the first position, the first chamber 40 of the inner mobile member 38 is aligned with the fastener track 30 of the inner stationary member at the front end of the inner mobile member 44. In this position, the second chamber 42 is aligned with a stop 64 of the inner stationary member 26 at the inner mobile member front end 44. The stop 64 preferably covers substantially the entire second chamber 42 at the front end of the inner mobile member 44. The inner stationary member 26 also includes a spacer 66 that defines an empty space 68 sized to retain at least the first chamber 40 of the inner mobile member within the outer stationary member 22. Additionally, as discussed above, the endcap openings 62 are aligned with the first and second chambers 40, 42 at the rear end of the inner mobile member 46.

The follower 24 is positioned within the follower channel 48 of the inner mobile member 38 to engage and urge fasteners within the first chamber 40 toward the inner stationary member fastener track 30 and the fastener passageway defined by the nosepiece 16 (shown in FIG. 1) so the fasteners can be driven into a substrate. Once all fasteners contained in the first chamber 40 have been driven into the substrate, a user may rotate the lever 52 to the second position.

Figure 7:
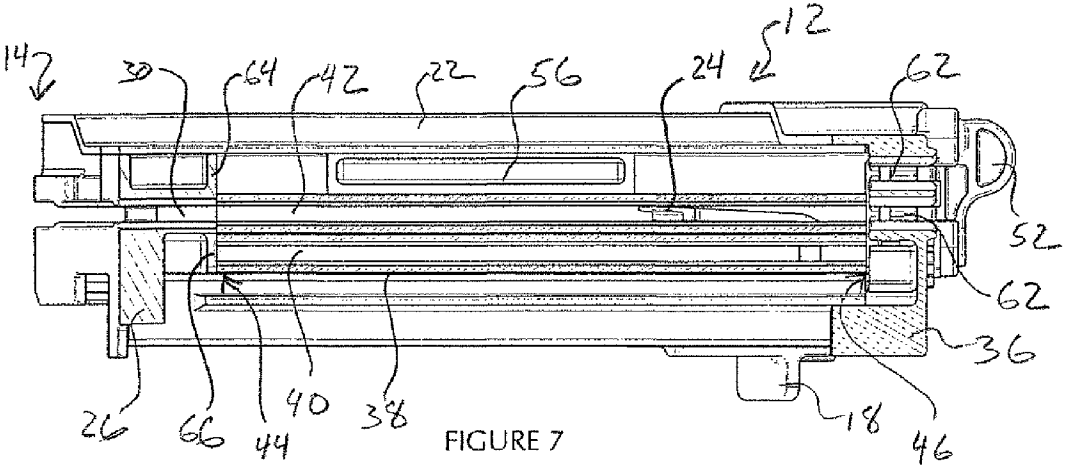
FIG. 7 is a cross-sectional plan view of the magazine assembly of FIG. 2, in the second position.

FIG. 7 shows a sectional plan view of the magazine 12 when the lever 52 is in the second position. When the lever is rotated toward the second position, the rotation of the lever 52 causes the cam shaft 54 and the cam lock 56 to rotate about an axis defined by the cam shaft. The rotation of the cam 56 overcomes the biasing force of the biasing mechanism 72 (best shown in FIG. 8), and moves the inner mobile member 38 laterally relative to the outer stationary member 22 in a direction transverse to the direction of fastener movement within the magazine so that the inner mobile member 38 is in a second position.

When the inner mobile member 38 is in the second position, the second chamber 42 is aligned with the fastener track 30 of the inner stationary member 26 at the front end of the inner mobile member 44, while the first chamber is moved into the empty space 68 defined by the spacer 66. Also, as previously noted, the first and second chambers 42 are no longer aligned with the endcap openings 62 at the rear end of the inner mobile member 46 to receive additional fasteners.

When the inner mobile member 38 is in the second position, the follower 24 extends through the follower channel 48 and the empty first chamber 40 of the inner mobile member to engage fasteners within the second chamber 42. The follower 24 thus urges fasteners within the second chamber 42 toward the inner stationary member fastener track 30, which the second chamber 42 is now aligned with, and into the fastener passageway defined by the tool nosepiece 16, so that the fasteners stored in the second chamber can be driven into the substrate. In this way, a user is able to drive multiple strips of fasteners into a substrate before being required to reload the first and second chambers 40, 42.

Figure 8:
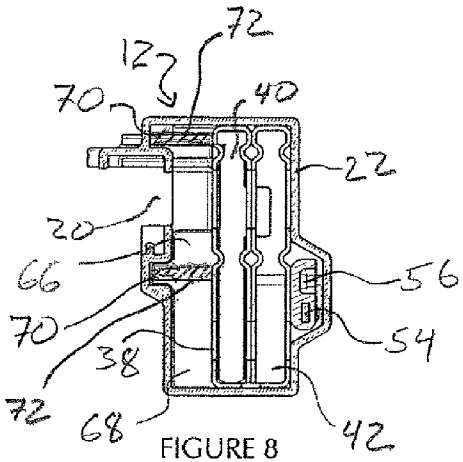
FIG. 8 is a cross-sectional rear elevation of the magazine assembly of FIG. 2.

Referring now to FIG. 8, cross section of the magazine 12 is shown. The magazine 12 further includes one or more spring pockets 70 in the outer stationary member 22. The spring pockets 70 are configured to at least partially contain the biasing mechanism 72, such as springs, biasing the inner mobile member 38 against the outer stationary member 22 and towards the first position. While springs are shown as the biasing mechanism 72, it will be appreciated that alternative biasing mechanisms may be used without departing from the scope of the invention.

While specific embodiments of the present side-by-side multi-strip magazine for a fastener driving tool have been shown and described, it will be appreciated by those skilled in the art that changes and modifications may be made thereto without departing from the invention in its broader aspects and as set forth in the following claims.

The invention claimed is:

1. A magazine assembly for a fastener driving tool having a nosepiece defining a fastener passageway, comprising:

an inner mobile member at least partially defining at least first and second chambers for receiving fasteners;

an outer stationary member at least partially surrounding said inner mobile member and engageable relative to the nosepiece;

said inner mobile member being movable relative to said outer member in a direction transverse to fastener travel in said magazine assembly;

a translational lever associated with said outer stationary member and having an actuator extending therefrom;

wherein movement of said translational lever causes said actuator to urge said inner mobile member to move between a first position and a second position; and an endcap mounted on said outer stationary member on an opposite end from the nosepiece, said lever being engaged with said endcap.

2. The magazine assembly of claim 1, wherein the outer stationary member has an inner stationary track member having a fastener track and a stop, wherein said fastener track is aligned with the fastener passageway of the tool nosepiece.

3. The magazine assembly of claim 2, wherein said inner stationary track member further comprises a blank defining a space sized to receive at least a portion of said inner mobile member.

4. The magazine assembly of claim 2, wherein when said inner mobile member is in said first position, said first chamber is aligned with said fastener track and said second chamber is aligned with said stop, and when said inner mobile member is in said second position, said first chamber is received in said space defined by said blank and said second chamber is aligned with said fastener track.

5. The magazine assembly of claim 4, wherein said actuator includes a cam rod rigidly connected to said translational lever and one or more cam locks rigidly mounted on said cam rod.

6. The magazine assembly of claim 4, further comprising a biasing mechanism biasing said inner mobile member toward said first position.

7. The magazine assembly of claim 4, further comprising said endcap having openings sized and positioned to allow fasteners to enter each of said first and second chambers.

8. The magazine assembly of claim 7, wherein said endcap includes a retainer for releasably and selectively retaining said translational lever in a selected one of a plurality of positions such that said inner mobile member is selectively retainable in either one of said first position and said second position.

9. The magazine assembly of claim 1, further comprising:

a follower slidably engaged in said outer stationary member for urging the fasteners toward a nosepiece end of the tool.

10. The magazine assembly of claim 1, wherein said outer stationary member has a longitudinal axis and an inner stationary track member having a fastener track and a stop, wherein said fastener track is aligned with the fastener passageway of the tool nosepiece; and the translational lever facilitating translational movement of said inner mobile member between the first position and the second position in a direction transverse to the direction of travel of fasteners in the magazine, said translational lever being rotatable about an axis extending parallel to the longitudinal axis of said outer stationary member.

11. The magazine assembly of claim 10, wherein the outer stationary member further comprises a blank defining a space sized to receive at least a portion of said inner mobile member.

12. The magazine assembly of claim 11, wherein when said inner mobile member is in said first position, said first chamber is aligned with said fastener track and said second chamber is aligned with said stop, and when said inner mobile member is in said second position, said first chamber is received in said space defined by said blank and said second chamber is aligned with said fastener track.

13. The magazine assembly of claim 10, further comprising a biasing member for biasing said movable member to said first position.

14. The magazine assembly of claim 10 further comprising:

a follower slidably engaged in said outer member for urging fasteners toward a nosepiece end of the tool.

15. The magazine assembly of claim 10, wherein said translational lever comprises:

a lever;

a cam rod rigidly mounted on said lever; and one or more cam locks rigidly mounted on said cam rod, wherein movement of said lever causes said cam rod and said plurality of can locks to rotate, urging said inner mobile member to move between said first position and said second position.

16. The magazine assembly of claim 15, further comprising a retainer for releasably and selectively retaining said lever in a selected one of a plurality of positions such that said inner mobile member is selectively retainable in either one of said first position and said second position.

* * * * *